US006787277B2

(12) United States Patent
Tong et al.

(10) Patent No.: US 6,787,277 B2
(45) Date of Patent: Sep. 7, 2004

(54) IMAGING MEMBERS

(75) Inventors: Yuhua Tong, Webster, NY (US); John F. Yanus, Webster, NY (US); Timothy J. Fuller, Pittsford, NY (US); Min-Hong Fu, Webster, NY (US); Dennis J. Prosser, Walworth, NY (US); Susan M. VanDusen, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/267,999

(22) Filed: Oct. 8, 2002

(65) Prior Publication Data

US 2004/0067427 A1 Apr. 8, 2004

(51) Int. Cl.[7] ..... G03G 5/047
(52) U.S. Cl. ..... 430/58.8; 430/120; 399/159
(58) Field of Search ..... 430/58.75, 58.8, 430/73, 120; 399/159

(56) References Cited

U.S. PATENT DOCUMENTS

| | | | | |
|---|---|---|---|---|
| 4,025,341 A | | 5/1977 | Rule | |
| 4,265,990 A | | 5/1981 | Stolka et al. | 430/96 |
| 4,286,033 A | | 8/1981 | Neyhart et al. | 430/60 |
| 4,291,110 A | | 9/1981 | Lee | 430/60 |
| 4,338,387 A | | 7/1982 | Hewitt | 430/85 |
| 4,410,616 A | | 10/1983 | Griffiths et al. | 430/46 |
| 4,806,443 A | | 2/1989 | Yanus et al. | 430/66 |
| 4,988,571 A | * | 1/1991 | Ueda | 430/59.6 |
| 4,988,597 A | | 1/1991 | Spiewak et al. | 430/62 |
| 5,059,503 A | * | 10/1991 | Muto et al. | 430/58.8 |
| 5,244,762 A | | 9/1993 | Spiewak et al. | 430/64 |
| 5,529,868 A | * | 6/1996 | Mashimo et al. | 430/58.8 |
| 5,737,669 A | * | 4/1998 | Ring | 399/130 |
| 6,156,468 A | * | 12/2000 | Wehelie et al. | 430/65 |

OTHER PUBLICATIONS

Diamond, A.S., ed., *Handbook of Imaging Materials*, Marcel Dekker, Inc., NY (1991), pp. 395–396.*

* cited by examiner

*Primary Examiner*—Janis L. Dote
(74) *Attorney, Agent, or Firm*—Oliff & Berridge, PLC

(57) ABSTRACT

A member including for example, a substrate, a charge generating layer, a charge transport layer comprising a synthesized mixture of N,N,N',N'-Tetra-p-tolyl-biphenyl-4,4'-diamine, N,N'-Diphenyl-N,N'-di-m-tolyl-biphenyl-4,4'-diamine, N,N'-Bis-(4-butyl-phenyl)-N,N'-di-p-tolyl-biphenyl-4,4'-diamine, N,N'-Bis-(4-butyl-phenyl)-N,N'-di-m-tolyl-biphenyl-4,4'diamine, N-Phenyl-N-m-tolyl-N',N'-di-p-tolyl-biphenyl-4,4'-diamine, N-(4-Butyl-phenyl)-N,N',N'-tri-p-tolyl-biphenyl-4,4'-diamine, N-(4-Butyl-phenyl)-N'-phenyl-N'-m-tolyl-N-p-tolyl-biphenyl-4,4'-diamine, N-(4-Butyl-phenyl)-N-m-tolyl-N',N'-di-p-tolyl-biphenyl-4,4'-diamine, N-(4-Butyl-phenyl)-N'-phenyl-N,N'-di-m-tolyl-biphenyl-4,4'-diamine, and N,N'-Bis-(4-butyl-phenyl)-N-m-tolyl-N'-p-tolyl-biphenyl-4,4'-diamine, and a film forming binder.

11 Claims, No Drawings

IMAGING MEMBERS

CROSS REFERENCE TO COPENDING APPLICATION

U.S. patent application Ser. No. 10/201,874, filed in the names of Y. Tong, et al. on Jul. 23, 2002, now issued U.S. Pat. No. 6,677,090, discloses a photoconductive imaging member which is comprised of a supporting substrate, and thereover a layer comprised of a charge transport layer comprising a charge transport material containing a dendrimeric molecular structure. The entire disclosure of this Patent Application is incorporated herein by reference.

BACKGROUND

The present invention is generally directed to layered imaging members, imaging apparatus, and processes thereof. More specifically, the present invention relates in general to electrophotographic imaging members and more specifically, to electrophotographic imaging members having a charge transport layer comprising mixtures of at least four different symmetric and/or unsymmetric charge transport components which are less susceptible to crystallization in polymer binders, and to processes for forming images on the member.

Numerous imaging members for electrostatographic imaging systems are known including selenium, selenium alloys, such as, arsenic selenium alloys, layered inorganic imaging and layered organic members. Examples of layered organic imaging members include those containing a change transporting layer and a charge generating layer. Thus, for example, an illustrative layered organic imaging member can be comprised of a conductive substrate, overcoated with a charge generator layer, which in turn is overcoated with a charge transport layer, and an optional overcoat layer overcoated on the charge transport layer. In a further "inverted" variation of this device, the charge transport layer can be overcoated with the photogenerator layer, or charge generator layer. Examples of generator layers that can be employed in these members include, for example, charge generator components, such as, selenium, cadmium sulfide, vanadyl phthalocyanine, x-metal free phthalocyanine, benzimidazole perylene (BZP), hydroxygallium phthalocyanine (HOGaPc), chlorogallium phthalocyanine, and trigonal selenium dispersed in binder resin, while examples of transport layers include dispersions of various diamines, reference for example, U.S. Pat. No. 4,265,990, the disclosure of which is incorporated herein by reference in its entirety.

One problem encountered with photoreceptors comprising a charge generating layer and the charge transport layer is that the charge transport component consisting of small organic molecules dissolved in a polymer binder can result in the small molecule crystallizing with increasing concentrations in the polymer binder. This crystallization can result in non-uniformity of images, increased residual voltages, and the early development of dynamic fatigue charge transport layer cracking during, for example, photoreceptor belt machine function. High quality images are essential for digital copiers, duplicators, printers, and facsimile machines, particularly laser exposure machines that demand high resolution images.

There continues to be a need for improved imaging members, and improved imaging systems utilizing such members. Additionally, there continues to be a need for imaging members with improved lifetimes and mechanical function, and which members are economical to prepare and retain their properties over extended periods of time.

REFERENCES

In U.S. Pat. No. 4,410,616, to Griffiths, et al., issued Oct. 18, 1983, there is disclosed an improved ambi-polar photoresponsive device useful in imaging systems for the production of positive images, from either positive or negative originals, which device is comprised of: (a) supporting substrate, (b) a first photogenerating layer, (c) a charge transport layer, and (d) a second photogenerating layer, wherein the charge transport layer is comprised of a highly insulating polymer resin having dissolved therein components of an electrically active material of N,N'-diphenyl-N,N'-bis("X substituted" phenyl)-(1,1,-biphenyl-4,4'-diamine wherein X is selected from the group consisting of alkyl and halogen.

U.S. Pat. No. 4,806,443 describes a charge transport layer including a polyether carbonate (PEC) obtained from the condensation of N,N'-diphenyl-N,N'bis(3-hydroxyphenyl)-(1,1'-biphenyl)-4,4'-diamine and diethylene glycol bischloroformate. U.S. Pat. No. 4,025,341 similarly describes a photoreceptor that includes a charge transport layer consisting of a mixture of polycarbonate and a low molecular weight photoconductive polymer from the condensation of a tertiary amine with an aldehyde. What is still desired is an improved material for a charge transport layer of an imaging member that exhibits excellent performance properties the same as or better than existing materials discussed above.

The entire disclosures of these patents are incorporated herein by reference.

BRIEF SUMMARY

Disclosed herein is an improved electrophotographic imaging member comprising a supporting substrate having an electrically conductive layer, a charge blocking layer, an optional adhesive layer, a charge-generating layer, a charge transporting layer comprising a synthesized mixture of at least four different symmetric and/or unsymmetric charge transport molecules represented by:

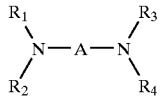

wherein $R_1$, $R_2$, $R_3$, $R_4$ are aryl groups with, for example, from about 6 to about 30 carbon atoms, such as phenyl, tolyl, xylyl, butylphenyl, chlorophenyl, fluorophenyl, naphthyl, and the like; A is a aromatic group bridge connecting two nitrogen atoms, with, for example, from about 6 to about 30 carbon atoms, such as phenylene, biphenyl, bitolyl, terphenyl, and the like, and wherein in embodiments the aforementioned groups may be substituted with, for example, halogen, and a film forming binder.

Further disclosed herein is an improved electrophotographic imaging member for which photoinduced discharge characteristic (PIDC) curves do not change with time or repeated use.

By the use of the disclosed synthesized mixture of symmetric and/or unsymmetric charge transport molecules in the charge transport layer of the present invention, a charge transport layer of an imaging member is achieved that has excellent hole transporting performance and wear resistance, and that is able to be coated onto the imaging member structure using known conventional methods.

Aspects illustrated herein relate to;

a substrate, a charge blocking layer, an optional adhesive layer, a charge generating layer, a charge transport layer comprising: a synthesized mixture of at least four different symmetric and/or unsymmetric charge transport molecules.

The disclosed mixture of symmetric and/or unsymmetric charge transport molecules can be readily synthesized by the preparative process illustrated, for example, in Scheme I:

Scheme I

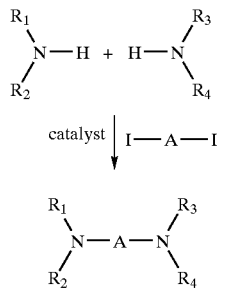

wherein $R_1$, $R_2$, $R_3$, $R_4$ are aryl groups with, for example, from about 6 to about 30 carbon atoms, such as phenyl, tolyl, xylyl, butylphenyl, chlorophenyl, fluorophenyl, naphthyl, and the like; A is a aromatic group bridge connecting two nitrogen atoms, with, for example, from about 6 to about 30 carbon atoms, such as phenylene, biphenyl, bitolyl, terphenyl, and the like, and wherein in embodiments the aforementioned groups may be substituted with, for example, halogen.

As indicated in Scheme I, the mixture of symmetric and/or unsymmetric charge transport molecules are prepared by, for example, an Ullmann condensation of the diarylamine intermediate with diiodide intermediate. The reaction is generally accomplished in an inert solvent, such as dodecane, tridecane, mesitylene, xylene, toluene, and the like, at a temperature ranging from about 100 degrees Celsius to about 280 degrees Celsius, and in embodiments from about 110 degrees Celsius to about 250 degrees Celsius. Any suitable catalysts for Ullmann condensation, including copper powder, cuprous iodide, cupric sulfate, tris(dibenzylideneacetone)dipalladium(0), and the like, may be employed for the process of the present invention. The reaction can be accelerated with an addition, in an effective amount, of a base such as an alkaline metal hydroxide, or carbonate including potassium hydroxide, potassium carbonate, sodium hydroxide, sodium carbonate, and the like. The product is isolated by known means, for example, by filtration, chromatography and distillation.

The imaging member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image.

Any suitable substrate may be employed in the imaging member of this invention. The substrate may be opaque or substantially transparent, and may comprise any suitable material having the requisite mechanical properties. Thus, for example, the substrate may comprise a layer of insulating material including inorganic or organic polymeric materials, such as, MYLAR® a commercially available polymer, MYLAR® coated titanium, a layer of an organic or inorganic material having a semiconductive surface layer, such as, indium, tin, oxide, aluminum, titanium and the like, or exclusively be made up of a conductive material, such as, aluminum, chromium, nickel, brass and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer.

The thickness of the substrate layer depends on numerous factors, including mechanical performance and economic considerations. The thickness of this layer may range from about 65 micrometers to about 3,000 micrometers, and in embodiments from about 75 micrometers to about 1,000 micrometers for optimum flexibility and minimum induced surface bending stress when cycled around small diameter rollers, for example, 19 millimeter diameter rollers. The surface of the substrate layer is preferably cleaned prior to coating to promote greater adhesion of the deposited coating composition. Cleaning may be effected by, for example, exposing the surface of the substrate layer to plasma discharge, ion bombardment, and the like methods.

Electron blocking layers for positively charged photoreceptors allow holes from the imaging surface of the photoreceptor to migrate toward the conductive layer. For negatively charged photoreceptors, any suitable charge blocking layer capable of forming a barrier to prevent hole injection from the conductive layer to the opposite photoconductive layer may be utilized. The charge blocking layer may include polymers such as polyvinylbutyral, epoxy resins, polyesters, polysiloxanes, polyamides, polyurethanes, and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $(H_2N(CH_2)_4)CH_3Si(OCH_3)_2$, gamma-aminobutyl) methyl diethoxysilane, and $(H_2N(CH_2)_3)CH_3Si(OCH_3)_2$, (gamma-aminopropyl)-methyl diethoxysilane, as disclosed in U.S. Pat. Nos. 4,338,387, 4,286,033 and 4,291,110. Other suitable charge blocking layer polymer compositions are also described in U.S. Pat. No. 5,244,762. These include vinyl hydroxyl ester and vinyl hydroxy amide polymers, wherein the hydroxyl groups have been partially modified to benzoate and acetate esters which modified polymers are then blended with other unmodified vinyl hydroxy ester and amide unmodified polymers. An example of such a blend is a 30 mole percent beuzoate ester of poly (2-hydroxyethyl methacrylate) blended with the parent polymer poly (2-hydroxyethyl methacrylate). Still, other suitable charge blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. Patents are incorporated herein by reference in their entirety.

The blocking layer is continuous and may have a thickness of less than about 10 micrometers because greater thicknesses may lead to undesirably high residual voltage. In embodiments, a blocking layer of from about 0.005 micrometers to about 1.5 micrometers facilitates charge neutralization after the exposure step and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment, and the like. For convenience in obtaining thin layers, the blocking layer is in embodiments applied in the form of a dilute solution, with the solvent being removed after deposition of the coating by conventional techniques, such as, by vacuum, heating, and the like. Generally, a weight ratio of blocking layer material and solvent of from about 0.05:100 to about 5:100 is satisfactory for spray coating.

If desired an optional adhesive layer may be formed on the substrate. Typical materials employed in an undercoat layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometers to about 30 micrometers. A thickness of from about 0.1 micrometers to about 3 micrometers is used in a specific embodiment. Optionally, the undercoat layer may contain suitable amounts of additives, for example, of from about 1 weight percent to about 10 weight percent, of conductive or nonconductive particles, such as, zinc oxide, titanium dioxide, silicon nitride, carbon black, and the like, to enhance, for example, electrical and optical properties. The undercoat layer can be coated onto a supporting substrate from a suitable solvent. Typical solvents include, for example, tetrahydrofuran, dichloromethane, xylene, ethanol, methyl ethyl ketone, and mixtures thereof.

The components of the photogenerating layer comprise photogenerating particles, for example, of Type V hydroxygallium phthalocyanine, x-polymorph metal free phthalocyanine, or chlorogallium phthalocyanine photogenerating pigments dispersed in a matrix comprising an arylamine hole transport molecules and certain selected electron transport molecules. Type V hydroxygallium phthalocyanine is well known and has X-ray powder diffraction (XRPD) peaks at, for example, Bragg angles (2 theta+/−0.2°) of 7.4, 9.8, 12.4, 16.2, 17.6, 18.4, 21.9, 23.9, 25.0, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The Diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments have an average particle size of less than about 5 micrometers.

The photogenerating layer containing photoconductive compositions and/or pigments and the resinous binder material generally ranges in thickness of from about 0.1 micrometer to about 5.0 micrometers, and in embodiments have a thickness of from about 0.3 micrometers to about 3 micrometers. The photogenerating layer thickness is generally related to binder content. Thus, for example, higher binder content of 30 compositions generally require thicker layers for photogeneration. Of course, thickness outside these ranges can be selected providing the objectives of the present invention are achieved.

The active charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, for example, 4,000 Angstroms to 8,000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generating layer. The active transport layer is normally transparent when exposure is effected through the active layer to ensure that most of the incident radiation is utilized by the underlying charge generating layer for efficient photogeneration. The charge transport layer in conjunction with the generating layer is a material which is an insulator to the extent that an electrostatic charge placed on the transport layer is not conductive in the absence of illumination, that is, does not discharge at a rate sufficient to prevent the formation and retention of an electrostatic latent image thereon.

In embodiments, a transport layer employed in the electrically operative layer in the photoconductor embodiment of this invention comprises from about 25 to about 75 percent by weight of at least one charge transporting aromatic amine compound, and about 75 to about 25 percent by weight of a polymeric film forming resin in which the aromatic amine is soluble. In a specific embodiment, the charge transport layer comprises a synthesized mixture of at least four different symmetric and/or unsymmetric charge transport molecules Examples of charge transporting aromatic amines for charge transport layer(s) capable of supporting the injection of photogenerated holes of a charge generating layer and transporting the holes through the charge transport layer include N,N'-diphenyl-N,N'-di(3-methylphenyl)-1,1-biphenyl-4,4'-diamine, (m-TBD).

Any suitable arylamine hole transporter molecules may be utilized in this invention. In embodiments an arylamine hole charge transport molecule may be represented by:

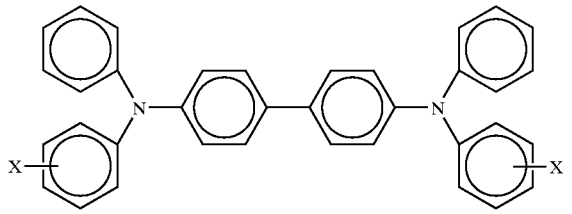

wherein X is selected from the group consisting of alkyl and halogen. The alkyl, for example, may contain from about 1 to about 10 carbon atoms, and in embodiments from about 1 to about 5 carbon atoms. Typical aryl amines include, for example, N,N'-diphenyl-N,N'-bis(alkylphenyl)-1,1-biphenyl-4,4'-diamine wherein alkyl is selected from the group consisting of methyl, ethyl, propyl, butyl, propyl, hexyl, and the like; and N,N'-diphenyl-N,N'-bis(halophenyl)-1,1'-biphenyl-4,4'-diamine, wherein the halo substituent is, in embodiments, a chloro substituent. Other specific examples of aryl amines include, 2,7-bis(phenyl-3-methylphenyl amino)fluorene, tritolylamine, N,N'-bis(3,4 dimethylphenyl)-N"(1-biphenyl) amine, 2-bis ((4'-methylphenyl) amino-p-phenyl) 1,1-diphenyl ethylene, 1-bisphenyl-diphenylamino-1-propene, and the like.

Any suitable inactive thermoplastic resin binder soluble in methylene chloride or other suitable solvent may be employed in the process of this invention to form the thermoplastic polymer matrix of the imaging member. Typical inactive resin binders soluble in methylene chloride include polycarbonate resin, polyvinylcarbazole, polyester, polyarylate, polyacrylate, polyether, polysulfone, polystyrene, polyamide, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between from about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is, in embodiments, maintained from about 2:1 to about 200:1 and in some instances as great as about 400:1.

In embodiments, the electrically inactive resin materials are polycarbonate resins, which have a molecular weight from about 20,000 to about 150,000, more specifically from about 50,000 to about 120,000. Most specifically, as the electrically inactive resin material is poly(4,4'-dipropylidene-diphenylene carbonate) with a molecular weight of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; a polycarbonate resin having a molecular weight of from about 50,000 to about 120,000, available as MAKROLON from Farbenfabricken Bayer A.G. and a polycarbonate resin having a molecular weight of from about 20,000 to about 50,000 available as MERLON from Mobay Chemical Company. Methylene chloride solvent is a desirable component of the charge transport layer coating mixture for adequate dissolving of all the components and for its low boiling point.

The charge transport layer material may also include additional additives used for their known conventional functions as recognized by practitioners in the art. Such as, for example, antioxidants, leveling agents, surfactants, wear resistant additives, such as, polytetrafluoroethylene (PTFE) particles, light shock resisting or reducing agents, and the like.

The solvent system can be included as a further component of the charge transport layer material. Conventional binder resins for charge transport layers have utilized the use of methylene chloride as a solvent to form a coating solution, for example, that renders the coating suitable for application via dip coating. However, methylene chloride has environmental concerns that usually require this solvent to have special handling and results in the need for more expensive coating and clean-up procedures. Currently, however, binder resins can be dissolved in a solvent system that is more environmentally friendly than methylene chloride, thereby enabling the charge transport layer to be formed less expensively than with some conventional polycarbonate binder resins. In embodiments, a solvent system for use with the charge transport layer material of the present invention comprises tetrahydrofuran, toluene, and the like.

The total solid to total solvents of the coating material may, for example, be around from about 10:90 weight percent to about 30:70 weight percent, and in embodiments from about 15:85 weight percent to about 25:75 weight percent.

The components may be added together in any suitable order, although the solvent system is in embodiments added to the vessel first. The transport molecule binder polymer may be dissolved together, although each is in embodiments dissolved separately and then combined with the solution in the vessel. Once all of the components of the charge transport layer material have been added to the vessel, the solution may be mixed to form a uniform coating composition.

The charge transport layer solution is applied to the photoreceptor structure. More in particular, the charge transport layer is formed upon a previously formed layer of the photoreceptor structure. In embodiments, the charge transport layer may be formed upon a charge generating layer. Any suitable and conventional techniques may be utilized to apply the charge transport layer coating solution to the photoreceptor structure. Typical application techniques include, for example, spraying, dip coating, extrusion coating, roll coating, wire wound rod coating, draw bar coating, and the like.

Any suitable multilayer photoreceptor may be employed in the imaging member of this invention. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. In embodiments, however, the charge transport layer is employed upon a charge generating layer, and the charge transport layer may optionally be overcoated with an overcoat and/or protective layer.

The following examples are provided to further define various species of the present invention, it being noted that these examples are intended to illustrate and not limit the scope of the present invention.

EXAMPLE I

A charge transport component mixture was prepared by combining 0.25 mole of di-4-tolylamine, 0.25 mole of N-3-methylphenyl,N'-phenylamine, 0.25 mole of N-n-butylphenyl,N'-4-methylphenylamine 0.25 mole of N-n-butylphenyl,N'-3-methylphenylamine and 0.5 mole of 1,4-diiodobiphenyl. The components were heated to 240 degrees Celsius for 18 hours under argon gas flow, using copper and potassium carbonate as catalysts. The reaction mixture was then cooled to room temperature. Toluene was used to extract the product. The product was purified by Filtrol and then carbon black. The final product was a kind of white powder with very good solubility in THF, methylene chloride, toluene. This product consists of 10 different charge transport molecules. The synthesis route is shown in Scheme 1.

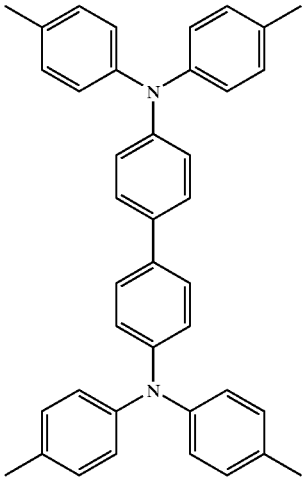

N,N,N′,N′-Tetra-p-tolyl-biphenyl-4,4′-diamine

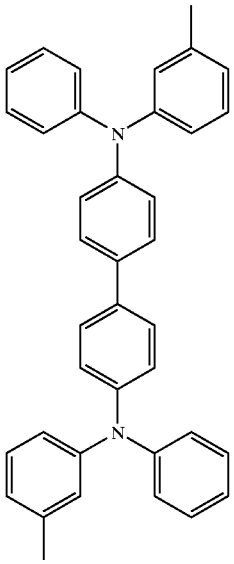

N,N′-Diphenyl-N,N′-di-m-tolyl-biphenyl-4,4′-diamine

-continued

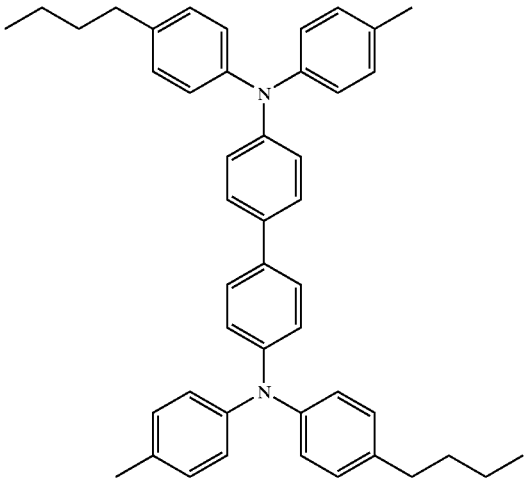

N,N′-Bis-(4-butyl-phenyl)-N,N′-di-p-tolyl-biphenyl-4,4′-diamine

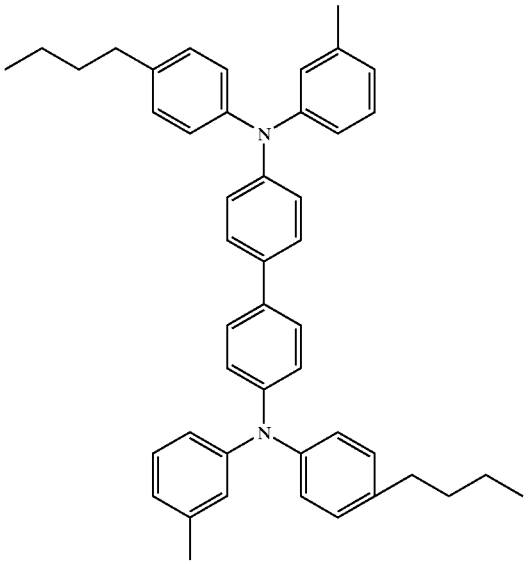

N,N′-Bis-(4-butyl-phenyl)-N,N′-di-m-tolyl-biphenyl-4,4′-diamine

-continued
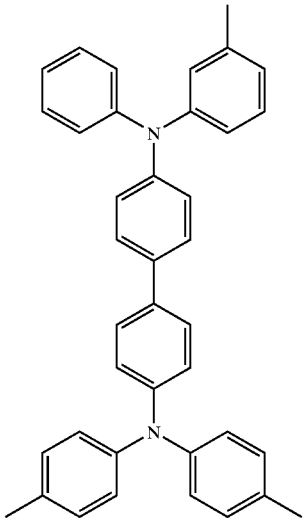
N-Phenyl-N-m-tolyl-N′,N′-di-p-tolyl-biphenyl-4,4′-diamine
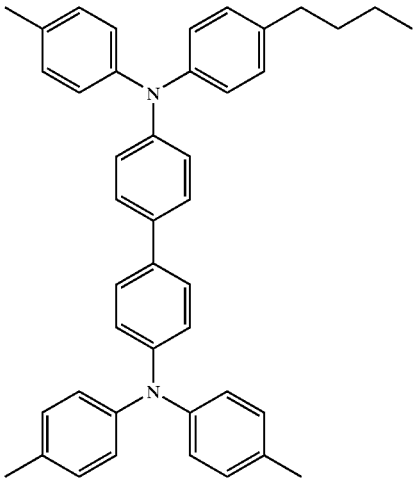
N-(4-Butyl-phenyl)-N,N′,N′-tri-p-tolyl-biphenyl-4,4′-diamine
-continued
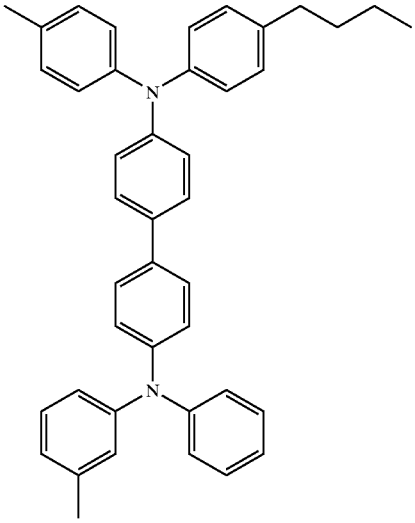
N-(4-Butyl-phenyl)-N′-phenyl-N′-m-tolyl-N-p-tolyl-biphenyl-4,4′-diamine
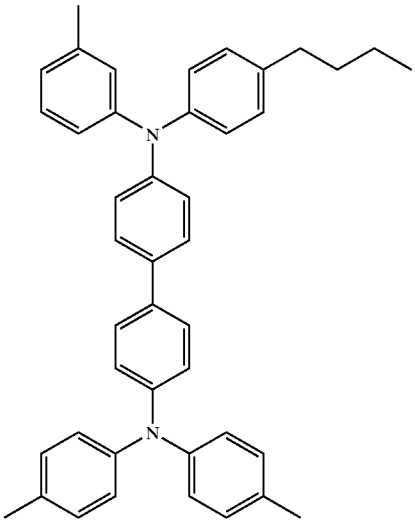
N-(4-Butyl-phenyl)-N-m-tolyl-N′,N′-di-p-tolyl-biphenyl-4,4′-diamine -continued

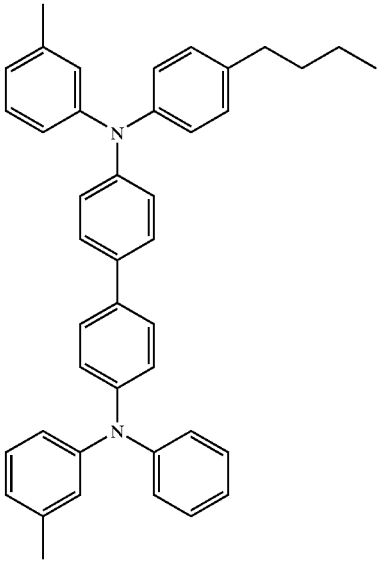

N-(4-Butyl-phenyl)-N′-phenyl-N,N′-di-m-tolyl-biphenyl-4,4′-diamine

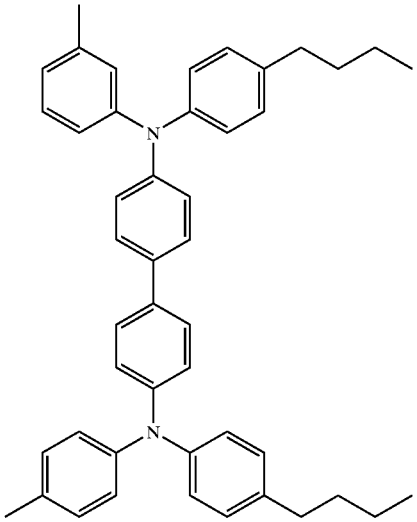

N,N′-Bis-(4-butyl-phenyl)-N-m-tolyl-N′-p-tolyl-biphenyl-4,4′-diamine

EXAMPLE II

Three photoreceptors were prepared by forming coatings using conventional techniques on a substrate comprising vacuum deposited titanium layer on a polyethylene terephthalate film. The first coating was a siloxane barrier layer formed from hydrolyzed gamma-aminopropyltriethoxysilane having a thickness of 0.005 micrometers (50 Angstroms). The barrier layer coating composition was prepared by mixing 3-aminopropyltriethoxysilane (available from PCR Research Center Chemicals of Florida) with ethanol in a 1:50 volume ratio. The coating composition was applied by a multiple clearance film applicator to form a coating having a wet thickness of 0.5 millimeter. The coating was then allowed to dry for 5 minutes at room temperature, followed by curing for 10 minutes at 110 degrees Centigrade in a forced air oven. The second coating was an adhesive layer of polyester resin (49,000, available from E.I. duPont de Nemours & Co.) having a thickness of 0.005 micrometers (50 Angstroms). The second coating composition was applied using a 0.5 millimeter bar and the resulting coating was cured in a forced air oven for 10 minutes. This adhesive interface layer was thereafter coated with a photogenerating layer containing 40 percent by volume hydroxygallium phthalocyanine and 60 percent by volume of a block copolymer of styrene (82 percent)/4-vinyl pyridine (18 percent) having a weight average molecular weight of 11,000. This photogenerating coating composition was prepared by dissolving 1.5 grams of the block copolymer of styrene/4-vinyl pyridine in 42 milliliters of toluene. To this solution was added 1.33 grams of hydroxygallium phthalocyanine and 300 grams of ⅛ inch diameter stainless steel shot. This mixture was then placed on a ball mill for 20 hours. The resulting slurry was thereafter applied to the adhesive interface with a Bird applicator to form a layer having a wet thickness of 0.25 millimeter. This layer was dried at 135 degrees Celsius for 5 minutes in a forced air oven to form a photogenerating layer having a dry thickness 0.4 micrometers. The next applied layer was a transport layer which was formed by using a Bird coating applicator to apply a solution containing 50 weight percent poly(4,4'-diphenyl-1,1'-cyclohexane carbonate)-400, with a weight average molecular weight of 40,000 and 50 weight percent of the new charge transport layer material mixture dissolved in THF/toluene mixture. The devices were oven dried at 100 degrees Celsius for 30 minutes.

The devices containing the newly mixed charge transport layer materials were scanned in a drum scanner. The charge transport was good and there was no cycle up in 10 k scanning cycles. With the above imaging members, it is believed that there can be generated images of excellent resolution with minimal or no background deposits. These imaging members are reusable for extended time periods.

Although the invention has been described with reference to specific preferred embodiments, it is not intended to be limited thereto, rather those having ordinary skill in the art will recognize that variations and modifications including equivalents, substantial equivalents, similar equivalents, and the like may be made therein which are within the spirit of the invention and within the scope of the claims.

What is claimed is:

1. An imaging member comprising an improved electrophotographic imaging member comprising a flexible supporting substrate having an electrically conductive layer, a charge blocking layer, a charge-generating layer, a charge transporting layer comprising a synthesized mixture of at least four different symmetric and/or unsymmetric charge transport molecules represented by:

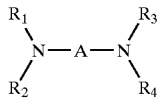

wherein $R_1$, $R_2$, $R_3$, $R_4$ are each selected from aryl groups comprising from about 6 to about 30 carbon atoms and halogen-substituted aryl groups comprising from about 6 to about 30 carbon atoms; A is selected from aromatic group bridges connecting two nitrogen atoms, comprising from about 6 to about 30 carbon atoms and halogen substituted aromatic group bridges connecting two nitrogen atoms, comprising from about 6 to about 30 carbon atoms;

wherein the synthesized mixture comprises:

N,N,N',N'-Tetra-p-tolyl-biphenyl-4,4'-diamine,

N,N'-Diphenyl-N,N'-di-m-tolyl-biphenyl-4,4'-diamine,

N,N'-Bis-(4-butyl-phenyl)-N,N'-di-p-tolyl-biphenyl-4,4'-diamine,

N,N'-Bis-(4-butyl-phenyl)-N,N'-di-m-tolyl-biphenyl-4,4'-diamine,

N-Phenyl-N-m-tolyl-N',N'-di-p-tolyl-biphenyl-4,4'-diamine,

N-(4-Butyl-phenyl)-N,N',N'-tri-p-tolyl-biphenyl-4,4'-diamine,

N-(4-Butyl-phenyl)-N'-phenyl-N'-m-tolyl-N-p-tolyl-biphenyl-4,4'-diamine,

N-(4-Butyl-phenyl)-N-m-tolyl-N',N'-di-p-tolyl-biphenyl-4,4'-diamine,

N-(4-Butyl-phenyl)-N'-phenyl-N,N'-di-m-tolyl-biphenyl-4,4'-diamine, and

N,N'-Bis-(4-butyl-phenyl)-N-m-tolyl-N'-p-tolyl-biphenyl-4,4'-diamine, dispersed in a binder.

2. An imaging member according to claim 1, wherein the charge transport layer is obtained by dispersing the components of the synthesized mixture and said binder in a solvent comprising tetrahydrofuran, toluene, or methylene chloride.

3. An imaging member according to claim 1, wherein said binder resin is a polymeric film forming resin in which the charge transport molecules in the synthesized mixture are soluble, and the charge transport layer comprises said binder in an amount of from about 25 to about 75 percent by weight.

4. An imaging member according to claim 1, wherein the charge transport layer comprises the synthesized mixture in an amount of from about 25 to about 75 percent by weight.

5. An image forming device comprising at least a photoreceptor, wherein the photoreceptor comprises a conductive substrate, a charge generating layer, a charge transport layer comprising a synthesized mixture of at least four different symmetric and/or unsymmetric charge transport molecules represented by:

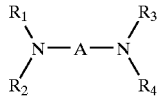

wherein $R_1$, $R_2$, $R_3$, $R_4$ are each selected from aryl groups comprising from 6 about to about 30 carbon atoms and halogen-substituted aryl groups comprising from about 6 to about 30 carbon atoms; A is selected from aromatic group bridges connecting two nitrogen atoms, comprising from about 6 to about 30 carbon atoms and halogen substituted aromatic group bridges connecting two nitrogen atoms, comprising from about 6 to about 30 carbon atoms, and a binder;

wherein the synthesized mixture comprises

N,N,N',N'-Tetra-p-tolyl-biphenyl-4,4'-diamine,

N,N'-Diphenyl-N,N'-di-m-tolyl-biphenyl-4,4'-diamine,

N,N'-Bis-(4-butyl-phenyl)-N,N'-di-p-tolyl-biphenyl-4,4'-diamine,

N,N'-Bis-(4-butyl-phenyl)-N,N'-di-m-tolyl-biphenyl-4,4'-diamine,

N-Phenyl-N-m-tolyl-N',N'-di-p-tolyl-biphenyl-4,4'-diamine,

N-(4-Butyl-phenyl)-N,N',N'-tri-p-tolyl-biphenyl-4,4'-diamine,

N-(4-Butyl-phenyl)-N'-phenyl-N'-m-tolyl-N-p-tolyl-biphenyl-4,4'-diamine,

N-(4-Butyl-phenyl)-N-m-tolyl-N',N'-di-p-tolyl-biphenyl-4,4'-diamine,

N-(4-Butyl-phenyl)-N'-phenyl-N,N'-di-m-tolyl-biphenyl-4,4'-diamine, and

N,N'-Bis-(4-butyl-phenyl)-N-m-tolyl-N'-p-tolyl-biphenyl-4,4'-diamine, dispersed in a binder.

6. An image forming device according to claim 5, wherein said binder comprises a polycarbonate.

7. An image forming device according to claim 6, wherein the polycarbonate is selected from the group consisting of poly(4,4'-isopropylidene-diphenylene)carbonate, and poly (4,4'-diphenyl-1,1'-cyclohexane carbonate).

8. The image forming device according to claim 5, wherein the photoreceptor is in the form of a belt.

9. An image forming device according to claim 5, wherein the photoreceptor is in the form of a drum.

10. An imaging process comprising providing an imaging member comprising a conductive supporting layer and a photogenerating layer, a charge transport layer, the charge transport layer comprising a synthesized mixture of N,N,N',N'-Tetra-p-tolyl-biphenyl-4,4'-diamine, N,N'-Diphenyl-N,N'-di-m-tolyl-biphenyl-4,4'-diamine, N,N'-Bis-(4-butyl-phenyl)-N,N'-di-p-tolyl-biphenyl-4,4'-diamine, N,N'-Bis-(4-butyl-phenyl)-N,N'-di-m-tolyl-biphenyl-4,4'-diamine, N-Phenyl-N-m-tolyl-N',N'-di-p-tolyl-biphenyl-4,4'-diamine, N-(4-Butyl-phenyl)-N,N',N'-tri-p-tolyl-biphenyl-4,4'-diamine, N-(4-Butyl-phenyl)-N'-phenyl-N'-m-tolyl-N-p-tolyl-biphenyl-4,4'-diamine, N-(4-Butyl-phenyl)-N-m-tolyl-N',N'-di-p-tolyl-biphenyl-4,4'-diamine, N-(4-Butyl-phenyl)-N'-phenyl-N,N'-di-m-tolyl-biphenyl-4,4'-diamine, and N,N'-Bis-(4-butyl-phenyl)-N-m-tolyl-N'-p-tolyl-biphenyl-4,4'-diamine, depositing a uniform electrostatic charge on the imaging member, exposing the imaging member to activating radiation in image configuration to form an electrostatic latent image, and developing the latent image with electrostatically attractable marking particles to form a toner image in conformance to the latent image.

11. An imaging process according to claim 10, wherein the photogenerating layer has a thickness of from about 0.1 micrometers to about 5.0 micrometers.

* * * * *